United States Patent [19]

Wigton

[11] Patent Number: 4,713,902

[45] Date of Patent: Dec. 22, 1987

[54] AMBIDEXTROUS OR LEFT-HANDED MAGAZINE CATCH FOR A PISTOL

[76] Inventor: Kevin Wigton, 11245 Old Hamburg Rd., Hamburg, Mich. 48139

[21] Appl. No.: 790,399

[22] Filed: Oct. 23, 1985

[51] Int. Cl.[4] ..... F41C 27/00

[52] U.S. Cl. ..... 42/7

[58] Field of Search ..... 42/7, 6

[56] References Cited

U.S. PATENT DOCUMENTS

| | | | |
|---|---|---|---|
| 4,326,353 | 4/1982 | Ludwig et al. | 42/7 |
| 4,429,479 | 2/1984 | Johnson | 42/6 |
| 4,521,985 | 6/1985 | Smith et al. | 42/7 |
| 4,599,818 | 7/1986 | Fedora et al. | 42/7 |
| 4,615,134 | 10/1986 | Beretta | 42/7 |

*Primary Examiner*—Charles T. Jordan

*Attorney, Agent, or Firm*—James M. Deimen

[57] ABSTRACT

A modified handgun or pistol provided with a magazine catch operable equally conveniently by a right or left-handed shooter in competitive shooting. The magazine catch mechanism includes a lever to draw out the catch. The lever is positioned for operation by the shooter's left thumb in addition to the button release positioned for the right thumb. Although on the opposite side of the gun handle, the lever moves the catch in the same direction as the button. The lever may be mounted in either of two positions for the left-handed shooter and can be added to an existing handgun having the right-handed button release with only minor modification to the gun. The lever is particularly adapted for the Colt 0.45 pistol, however, it is not limited to this particular gun.

5 Claims, 8 Drawing Figures

FIG. 4
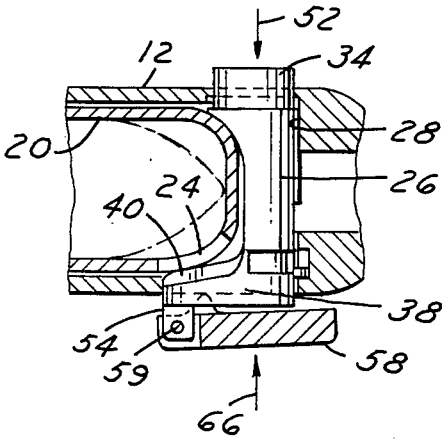
FIG. 5
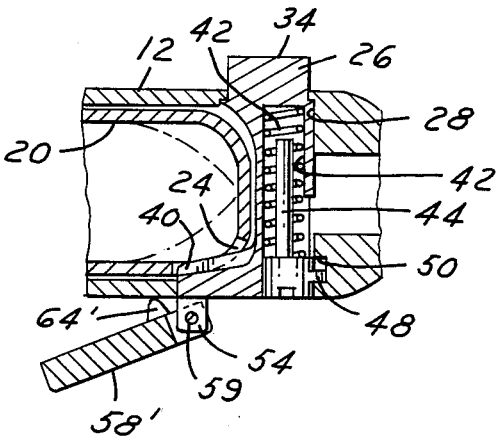
FIG. 7
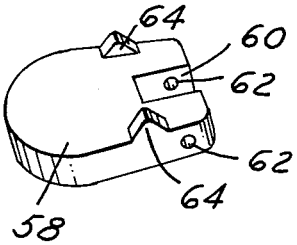
FIG. 8
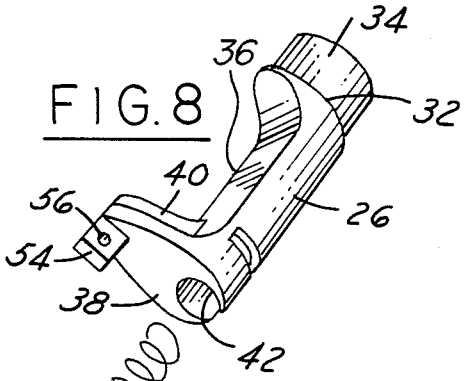
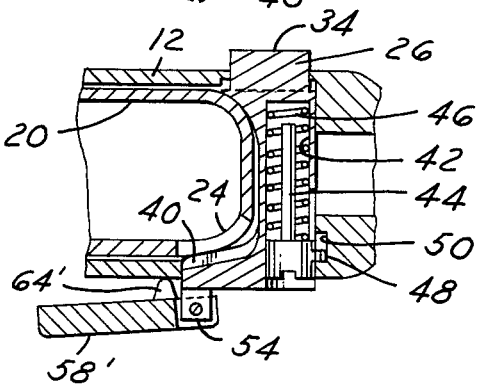
FIG. 6

AMBIDEXTROUS OR LEFT-HANDED MAGAZINE CATCH FOR A PISTOL

BACKGROUND OF THE INVENTION

The field of the invention pertains to pistols and handguns and in particular to pistols and handguns used for target and competitive shooting. Various mechanical features of such guns such as safety catches and magazine catches are actuated by push buttons or levers positioned on the gun for right-handed persons, by far the largest percentage of the population. Such positioning makes awkward the operation of the buttons or levers by left-handed persons. In target and competitive shooting the awkwardness of the right-handed guns puts the left-handed shooter at an unfair disadvantage.

In view of the awkwardness of right-handed guns various ambidextrous or left-hand operable features have been added to handguns. U.S. Pat. No. 4,414,769 discloses an ambidextrous safety catch at the upper rear of the hand-grip of a Colt pistol. A pair of rotatable levers are located on either side of the hand-grip and connected by a mechanical interlock mechanism therebetween.

U.S. Pat. No. 4,236,337 and U.S. Pat. No. 4,449,311 disclose reversible magazine catches for pistols, however, these magazine catches require disassembly of the mechanisms from the pistols for reversal. U.S. Pat. No. 4,326,353 discloses a magazine catch that slides into and out of engagement from either side of the handle to provide an ambidextrous catch for a Walther pistol. The levers on either side pivot about a centrally located lever latch within the hand-grip.

SUMMARY OF THE INVENTION

A Colt handgun or pistol has a handle or butt with a grip on either side and a magazine therewithin to supply bullets for semi-automatic operation. On the upper forward portion of the handle behind the trigger guard and on the left side is a button pin release for the magazine catch. The button is conveniently located for operation by the right thumb of the shooter.

Added to the button pin at the opposite end thereof is a lever mechanism operable by the left thumb of a left-handed shooter. The lever mechanism draws the button pin rightwardly in the same direction as when the left side button is depressed by a right-handed shooter. The lever that draws the pin may be positioned in either of two locations for the convenience of the left-handed shooter or to clear the grip on the handle. The lever includes a split pivot to span the button pin opening in either of the two locations. With a minor modification to the button pin the lever mechanism can be added to existing handguns at very reasonable cost.

DESCRIPTION OF THE DRAWINGS

FIG. 4 is a cutaway partial section of the button pin mechanism shown released and taken along the line 2—2 of FIG. 1.

FIG. 5 is a cutaway partial section of the button pin taken through the pin in the latched position with the lever in the alternate position and taken along the line 2—2 of FIG. 1;

FIG. 6 is a cutaway partial section of the button pin taken through the pin in unlatched position with the lever in the alternate position and taken along the line 2—2 of FIG. 1;

FIG. 7 is a perspective view of the lever; and,

FIG. 8 is a perspective exploded view of the button pin as modified for the lever.

DESCRIPTION OF THE PREFERRED EMBODIMENTS

Figure 1:
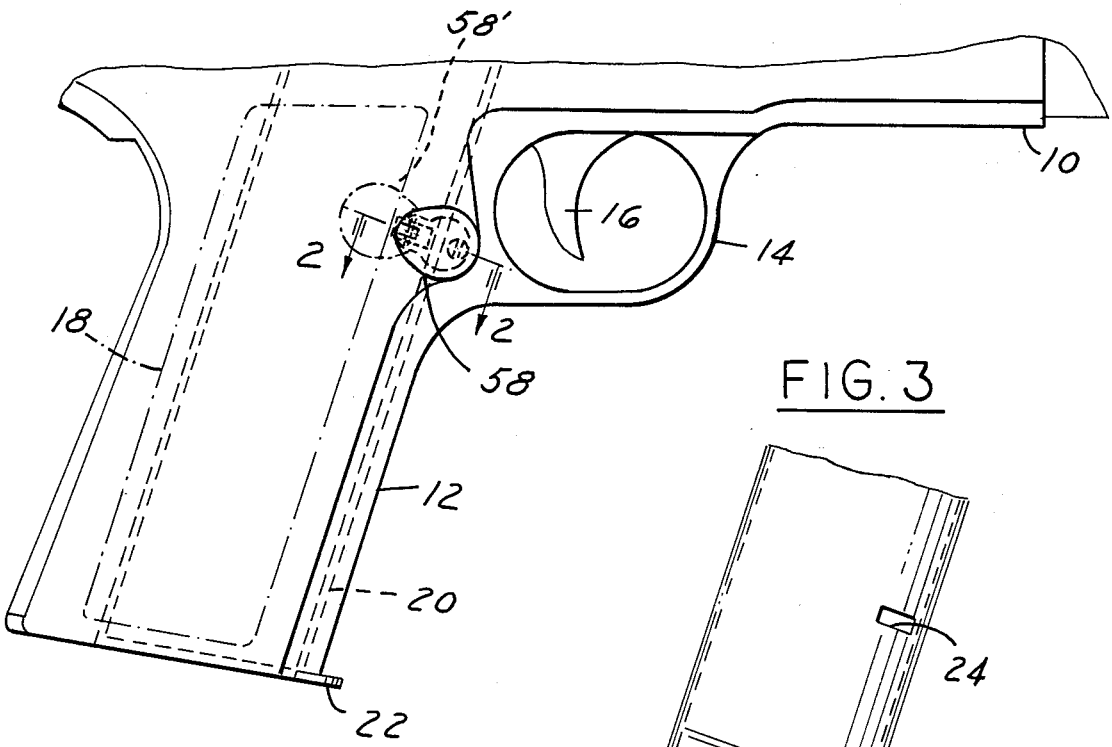
FIG. 1 is a cutaway side view of the pistol.
Figure 3:
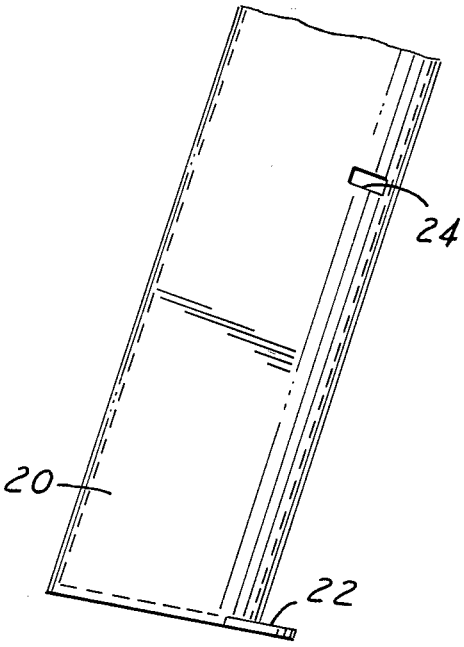
FIG. 3 is a partial side view of a bullet magazine for the pistol of FIG. 1.

Illustrated in FIG. 1 is a handgun or pistol having a barrel 10, a handle 12 and a trigger guard 14 for the trigger 16. The handle 12 may or may not be equipped with plastic grips 18 on either side. Through an aperture in the bottom of the handle 12 may be inserted a bullet magazine 20 such as that shown in FIG. 3. The magazine has a tab 22 which acts as a stop when inserted in the handle 12. Also shown is a catch slot 24 in the curved forward portion of the magazine 20.

Figure 2:
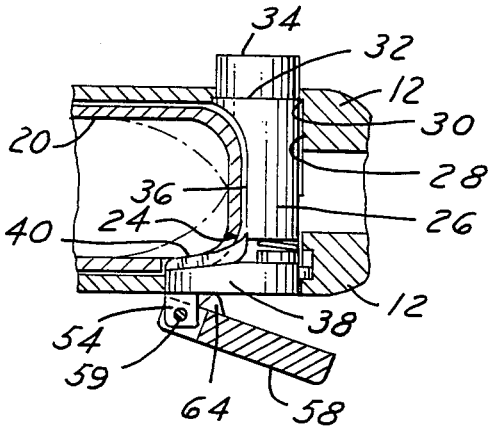
FIG. 2 is a cutaway partial section of the button pin mechanism shown latched and taken along the line 2—2 of FIG. 1.

Referring to FIGS. 1 and 2 a button pin 26 extends through a hole 28 in the handle 12. The hole 28 includes a shoulder at 30 to engage a shoulder 32 on the button pin 26. The button portion 34 of the pin 26 extends out from the handle 12 as shown. As also illustrated in FIG. 8 the button pin is relieved at 36 to clear the magazine 20 and includes an extension 38 at the end opposite the button 34. On the inside of the extension 38 is a catch 40 to engage the magazine 20 by means of the slot 24.

As better shown in FIGS. 5 and 6, within a bore 42 in the button pin 26 is a shouldered pin 44 and spring 46. Extending from the shouldered pin 44 is a tab 48 which engages a short slot 50 formed in the wall of the hole 28 in the handle 12. By pressing the button 34 the button pin 26 is depressed as shown by arrow 52 in FIG. 4 and the catch 40 disengages the magazine slot 24 to release the magazine. Release of the button 34 allows spring 46 to urge the button pin 26 back into engagement against shoulder 30 of the hole 28. The button 34 is most conveniently operated by the right thumb of a right-handed shooter.

Extending from the pin extension 38 opposite the catch 40 is a lever tab 54 having a small hole 56 therethrough as best shown in FIG. 8. The lever 58 shown in FIG. 7 is bifurcated 60 at one end with a pin hole 62 bored through the fork as shown. The lever also includes on its underside as shown a bifurcated fulcrum in the form of two rocker tabs 64. The lever 58 is pinned 59 above the extension 38 through the holes 56 and 62. As shown in FIG. 2 and FIG. 4 the two rocker tabs 64 straddle the oblong end of the hole 28 in the handle 12 that accommodates the extension 38 of the button pin 26. Depressing the lever 58 as shown by arrow 66 rocks the lever about the fulcrum 64 drawing the button pin 26 and extension 38 in the direction of arrow 52 thus again releasing the catch 40 from the slot 24.

In FIGS. 5 and 6 the lever is shown in the alternate position 58' but pinned 59 to the lever tab 54 as above with the fulcrum tabs 64' engaging the handle 12. Depressing the lever 58' as shown again draws the button pin 26 and extension 38 out to release the catch 40 from the slot 24. The alternate lever position provides a second position for the convenience of a left-handed shooter and is available where there is no interference with the grip 18.

The button pin 26 can be manufactured with an integral lever tab 54 as original equipment or the tab can be welded or brazed to an existing button pin. Thus, the addition of the lever 58 for left-handed shooters is simple and economical to accomplish.

I claim:

1. In a piston comprising a barrel, a handle and a magazine insertable in the handle, said handle including a transverse button pin extending from the left side of the handle and integral means extending from the button pin to engage and release the insertable magazine, the improvement comprising a lever on the right side of the handle, means on said integral means extending from said button pin and on the lever for engagement therebetween and a bifurcated fulcrum on said lever in engagement with said handle and astraddle said button pin.

2. The pistol of claim 1 wherein the lever is reversible in position about the engagement means on said integral means extending from said button pin.

3. The pistol of claim 2 wherein the fulcrum on said lever straddles the button pin in only one of said lever positions.

4. In a pistol comprising a barrel, a handle and a magazine insertable in the handle, said handle including a transverse button pin extending from the left side of the handle and integral means extending from the button pin to engage and release the insertable magazine, the improvement comprising a lever on the right side of the handle, means on said integral means extending from said button pin and on the lever for engagement therebetween and a bifurcated fulcrum on said lever in engagement with said handle, said lever being bifurcated about the means on said button pin for engagement with said lever and said fulcrum being astraddle said button pin.

5. The piston of claim 4 wherein the lever is reversible in position about the engagement means on said integral means extending from said button pin.

* * * * *